US008256364B2

(12) United States Patent
Vaughan et al.

(10) Patent No.: US 8,256,364 B2
(45) Date of Patent: Sep. 4, 2012

(54) METHODS AND DEVICES FOR CONTROLLING THE TENSION OF YARN IN A TUFTING MACHINE

(75) Inventors: Neil Vaughan, Rydal, GA (US); Mark Honeycutt, Cartersville, GA (US); James Jarrett, Cartersville, GA (US)

(73) Assignee: Columbia Insurance Company, Omaha, NE (US)

( * ) Notice: Subject to any disclaimer, the term of this patent is extended or adjusted under 35 U.S.C. 154(b) by 76 days.

(21) Appl. No.: 12/915,716

(22) Filed: Oct. 29, 2010

(65) Prior Publication Data

US 2011/0100277 A1 May 5, 2011

Related U.S. Application Data

(60) Provisional application No. 61/257,699, filed on Nov. 3, 2009.

(51) Int. Cl.
*D05C 15/00* (2006.01)

(52) U.S. Cl. ..... 112/475.23

(58) Field of Classification Search ..... 112/475.23, 112/2.2, 98, 103, 220, 221, 80.5, 80.01, 80.08, 112/7, 475.19
See application file for complete search history.

(56) References Cited

U.S. PATENT DOCUMENTS

| | | | | |
|---|---|---|---|---|
| 2,042,503 | A * | 6/1936 | Carter | 112/410 |
| 3,529,560 | A | 9/1970 | Jackson | |
| 3,762,346 | A | 10/1973 | Cobble | |
| 4,062,308 | A | 12/1977 | Spanel et al. | |
| 4,069,775 | A | 1/1978 | Bryant et al. | |
| 4,103,635 | A | 8/1978 | Sedlaczek | |
| 4,151,805 | A | 5/1979 | Long et al. | |
| 4,173,192 | A | 11/1979 | Schmidt et al. | |
| 4,313,578 | A | 2/1982 | Van Wilson et al. | |
| 4,586,446 | A | 5/1986 | Cooper | |
| 4,895,087 | A | 1/1990 | Amos | |
| 5,588,383 | A | 12/1996 | Davis et al. | |
| 5,738,030 | A * | 4/1998 | Ok | 112/475.23 |
| 5,743,306 | A | 4/1998 | Stewart et al. | |
| 5,769,012 | A | 6/1998 | Vaughan et al. | |
| 6,283,052 | B1 | 9/2001 | Pratt | |
| 6,877,447 | B2 * | 4/2005 | Frost et al. | 112/80.73 |
| 7,814,850 | B2 * | 10/2010 | Bearden | 112/80.4 |

FOREIGN PATENT DOCUMENTS

WO WO0159192 8/2001

* cited by examiner

*Primary Examiner* — Tejash Patel
(74) *Attorney, Agent, or Firm* — Ballard Spahr LLP

(57) ABSTRACT

A tufting machine for forming tufted carpet having means for inserting loops of at least two different yarns into a backing material moving through the tufting machine and means for controlling the deviation of the ratio of different yarns projecting from a top surface of the backing material. It is contemplated that the tufting machine can be used to maintain the color of the tufted carpet at a desired color during the operation of the tufting machine.

16 Claims, 5 Drawing Sheets

METHODS AND DEVICES FOR CONTROLLING THE TENSION OF YARN IN A TUFTING MACHINE

CROSS-REFERENCE TO RELATED APPLICATION

This application claims the benefit of priority to U.S. Provisional Patent Application Ser. No. 61/257,699, filed on Nov. 3, 2009, the entire disclosure of which is incorporated by reference herein for all purposes.

FIELD OF THE INVENTION

This invention relates to a tufting machine for forming tufted carpet. More specifically, this invention relates to a tufting machine for maintaining the color of tufted carpet at a desired color during operation of the tufting machine.

BACKGROUND OF THE INVENTION

During the operation of known tufting machines, loops of yarn are inserted into a carpet backing to create a desired color profile of yarns projecting from the carpet backing However, when the tufting machine accelerates or decelerates, the tension of the yarns can change, and loose motion in the components of the tufting machine can occur. These changes in yarn tension and the motion of the tufting machine can create textural variations in the carpet formed during periods of acceleration and deceleration. Additionally, when these changes in yarn tension and machine motion occur immediately before or after a machine stop, stop marks in the carpet can occur.

Thus, there is a need in the pertinent art for a tufting machine that can maintain the color of tufted carpet at a desired color during acceleration and deceleration of the tufting machine. Additionally, there is a need in the pertinent art for a tufting machine that can reduce the incidence of stop marks before or after machine stops.

SUMMARY

The invention relates to a tufting machine for forming tufted carpet. The tufting machine can be used to maintain the color of the tufted carpet at a desired color during the operation of the tufting machine. In one aspect, the tufting machine forms tufted carpet on a backing material moving in a machine direction through the tufting machine.

In one aspect, the tufting machine has means for inserting loops of yarn into the backing material. In this aspect, the loops of yarn can be inserted into the backing material to form sequential substantially linear rows of yarn tufts thereon the backing material. In another aspect, at an operational speed of the tufting machine, each respective linear row of yarn tufts can have an operational ratio of at least two different yarns projecting outwardly from a top surface of the backing material. In a further aspect, for each respective linear row of yarn tufts, the at least two different yarns projecting therefrom the top surface of the backing material can form a desired color.

In another exemplary aspect, the tufting machine has means for controlling the deviation of the ratio of different yarns projecting outwardly from the top surface of the backing material of each linear row relative to the operational ratio. In this aspect, the deviation of the ratio of different yarns can be controlled as the speed of the tufting machine deviates from the operational speed. In one exemplary aspect, the deviation of the ratio can be controlled such that each linear row formed at a deviated speed or speeds is substantially the same color as the desired color.

BRIEF DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
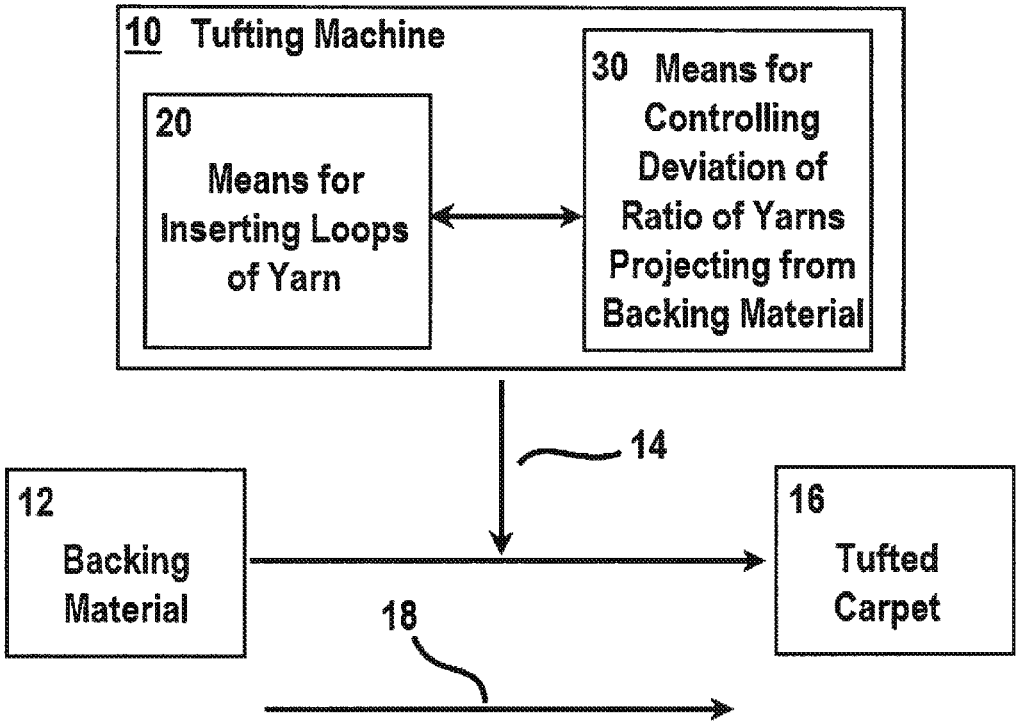
FIG. 1 is a schematic diagram depicting an exemplary tufting machine as described herein.

The present invention can be understood more readily by reference to the following detailed description, examples, drawings, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a yarn" can include two or more such yarns unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the definition of the term "color" is referenced in terms of the CIELAB color scale, which was created by the International Commission on Illumination (CIE). The CIELAB color scale provides a uniform scale for measuring and comparing the color values of different samples. Three different color measurements are used to determine the CIELAB color value of a given sample: 1) a white-black color measurement; 2) a red-green color measurement; and 3) a yellow-blue color measurement. The white-black color measurement represents the amount of white present in the sample relative to the amount of black present in the sample. The red-green color measurement represents the amount of red present in the sample relative to the amount of green present in the sample. The yellow-blue color measurement represents the amount of yellow present in the sample relative to the amount of blue present in the sample. CIELAB color scale values can be obtained using color measurement instruments known in the art, including, for example, HunterLab color measurement instruments.

As used herein, the terms "optional" or "optionally" mean that the subsequently described event or circumstance may or may not occur, and that the description includes instances where said event or circumstance occurs and instances where it does not.

In one embodiment, and with reference to FIGS. 1-5, the invention relates to a tufting machine 10 for forming tufted carpet 16. The tufting machine 10 can be used to maintain the color of the tufted carpet 16 at a desired color during the operation of the tufting machine. In one aspect, the tufting machine 10 forms tufted carpet on a backing material 12 moving in a machine direction 18 through the tufting machine. In another aspect, the backing material 12 have a top surface.

In one aspect, the tufting machine 10 comprises means 20 for inserting loops of yarn into the backing material 12. In this aspect, the loops of yarn 14 can be inserted into the backing material 12 to form sequential substantially linear rows of yarn tufts thereon the backing material. It is contemplated that the sequential substantially linear rows of yarn tufts thereon the backing material 12 can be substantially transverse to the machine direction 18. It is further contemplated that the sequential substantially linear rows of yarn tufts thereon the backing material are spaced substantially equally apart in the machine direction 18. In another aspect, a portion of each yarn tuft can project from the top surface of the backing material 12. In an additional aspect, at an operational speed of the tufting machine 10 each respective linear row of yarn tufts can have an operational ratio of at least two different yarns projecting outwardly from the top surface of the backing material 12. In a further aspect, for each respective linear row of yarn tufts, the at least two different yarns projecting from the top surface of the backing material 12 can form a desired color.

In another aspect, the tufting machine 10 can comprise means 30 for controlling the deviation of the ratio of different yarns projecting from the top surface of the backing material of each linear row relative to the operational ratio. In this aspect, the deviation of the ratio can be controlled as the speed of the tufting machine 10 deviates from the operational speed. In one exemplary aspect, the deviation of the ratio can be controlled such that each linear row formed at a deviated speed is substantially the same color as the desired color.

Figure 2:
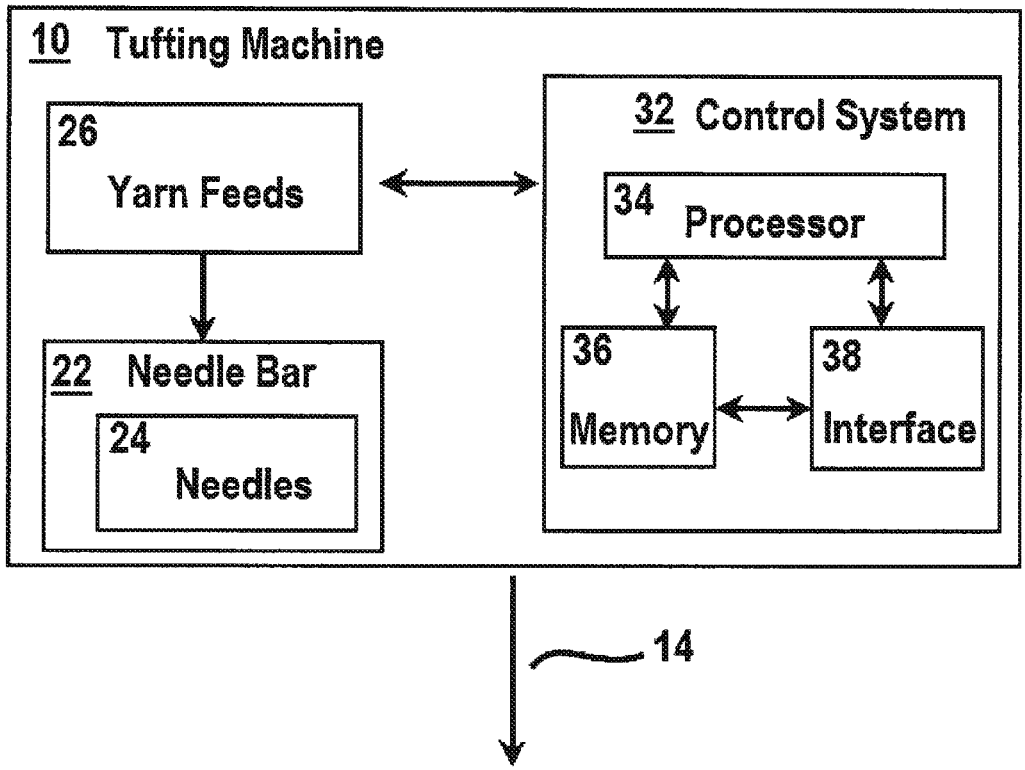
FIG. 2 is a schematic diagram depicting an exemplary tufting machine having a control system in communication with a plurality of yarn feeds, as described herein.

In an additional aspect, and with reference to FIG. 2, the means 20 for inserting loops of yarn into the backing material can comprise a needle bar 22 having a plurality of needles 24 mounted thereon. In one aspect, the means 20 for inserting loops of yarn into the backing material can further comprise a plurality of yarn feeds 26. In this aspect, each yarn feed 26 of the plurality of yarn feeds can be in operative communication with a needle 24 of the plurality of needles. In another aspect, each yarn feed 26 of the plurality of yarn feeds can comprise a respective yarn. In a further aspect, each yarn feed 26 of the plurality of yarn feeds can provide yarn to a corresponding needle 24 of the plurality of needles at a selectable yarn feed rate. In still a further aspect, each yarn feed 26 of the plurality of yarn feeds can further comprise means for selectively adjusting the yarn feed rate. As one having ordinary skill in the pertinent art will appreciate, any means known in the art for inserting loops of yarn into a carpet backing can be used to insert loops of yarn into the backing material.

In one aspect, as shown in FIG. 2, the means 30 for controlling the deviation of the ratio of different yarns projecting from the top surface of the backing material of each linear row relative to the operative ratio can comprise a control system 32. In one exemplary aspect, the control system 32 can comprise a processor 34 coupled to each yarn feed 26 of the plurality of yarn feeds. In another aspect, the processor 34 of the control system 32 can be configured to control the respective yarn feed rate of each yarn feed 26 of the plurality of yarn feeds in response to deviation of the speed of the tufting machine 10 from the operational speed.

As one having ordinary skill in the pertinent art will appreciate, the processor 34 can be any processing element known in the art, such as, without limitation, a personal computer or a server computer. As one having ordinary skill in the pertinent art will further appreciate, the processor 34 can comprise any of a number of processing devices, systems or the like that are capable of operating in accordance with the embodiments of the invention. It is contemplated that the processor 34 can be in communication with a memory 36 that stores content, data, or the like. The memory 36 can also store software applications, instructions, or the like for the processor 34 to perform steps associated with the deviation of the ratio of different yarns projecting from the top surface of the backing material 12 of each linear row relative to the operative ratio, as described herein.

It is further contemplated that the processor 34 can be connected to at least one interface 38 or other means for displaying, transmitting, and/or receiving data, content, or the like. The interface 38 can include at least one communication interface or other means for transmitting and/or receiving data, content, or the like, as well as at least one user interface that can include a display and/or a user input interface. The user input interface, in turn, can comprise any of a number of devices allowing the processor 34 to receive data from a user, such as a keypad, a touch display, a joystick or other input device. In one aspect, the control system 32 can be configured to signal at least one yarn feed 26 of the plurality of yarn feeds to change its yarn feed rate to a selected yarn feed rate.

When the tufting machine 10 is operating at the operational speed, each yarn feed 26 of the plurality of yarn feeds can have a normal feed rate. In one aspect, the control system 32 can be configured to vary the yarn feed rate of at least one yarn feed 26 of the plurality of yarn feeds substantially linearly from the normal feed rate to a selected yarn feed rate. In another aspect, the control system 32 can be configured to vary the yarn feed rate of at least one yarn feed 26 of the plurality of yarn feeds substantially non-linearly from the normal feed rate to a selected yarn feed rate.

Figure 3:
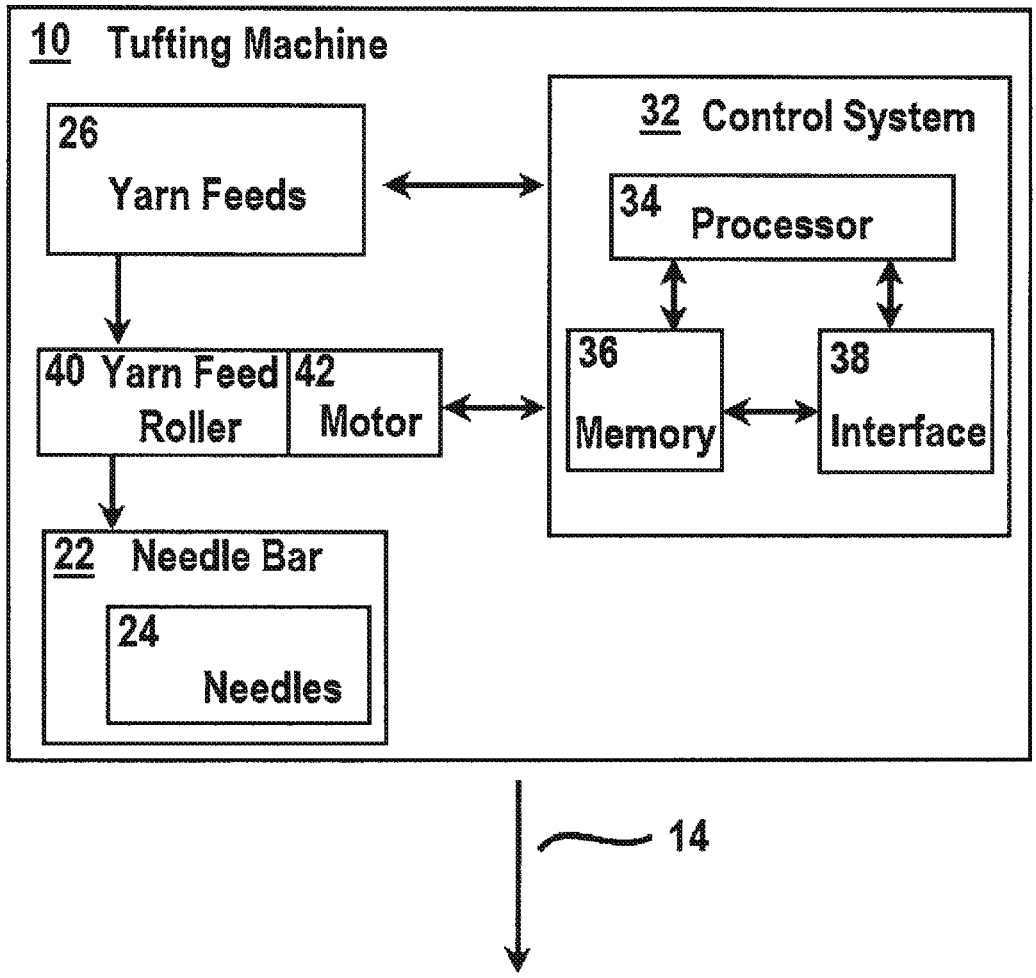
FIG. 3 is a schematic diagram depicting an exemplary tufting machine having a yarn feed roller as described herein.

In an additional aspect, and with reference to FIG. 3. the means 30 for controlling the deviation of the ratio of different yarns projecting outwardly from the top surface of the backing material of each linear row relative to the operative ratio can further comprise at least one yarn feed roller 40 in operative communication with a corresponding yarn feed 26. in another aspect, the means 30 for controlling the deviation of the ratio of different yarns projecting from the top surface of the backing material of each linear row relative to the operative ratio can further comprise at least one motor 42. In this aspect, it is contemplated that each motor 42 of the at least one motor can be coupled to a corresponding yarn feed roller 40. Further, each motor 42 of the at least one motor can be configured to drive the corresponding yarn feed roller 40 to selectively adjust the yarn feed rate of the corresponding yarn feed 26.

Figure 4:
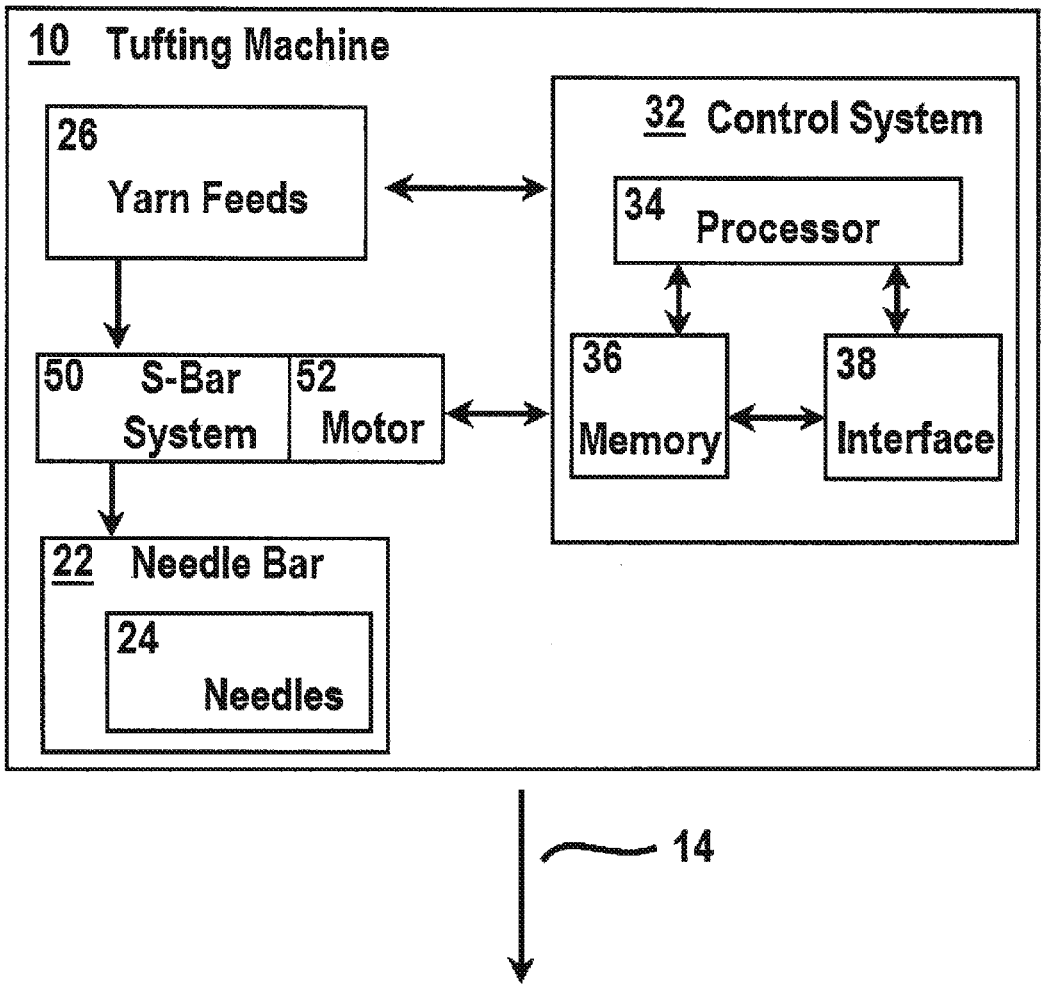
FIG. 4 is a schematic diagram depicting an exemplary tufting machine having an S-bar system as described herein.

Alternatively, as shown in FIG. 4, the means 30 for controlling the deviation of the ratio of different yarns projecting outwardly from the top surface of the backing material of each linear row relative to the operative ratio can further comprise at least one s-bar system 50 as is commonly known in the pertinent art. Each s-bar system 50 of the at least one s-bar system can be in operative communication with a corresponding yarn feed 26. In one aspect, the means 30 for controlling the deviation of the ratio of different yarns projecting from the top surface of the backing material of each linear row relative to the operative ratio can further comprise at least one motor 52. In this aspect, each motor 52 of the at least one motor can be coupled to a corresponding s-bar system 50. Further, each motor 52 of the at least one motor can be configured to rotate the corresponding s-bar system 50 to selectively adjust the yarn feed rate of the corresponding yarn feed 26. The at least one motor 52 can comprise various types of motors known in the art, including, for example and without limitation, direct current motors, stepper motors, servo motors, and the like.

Figure 5:
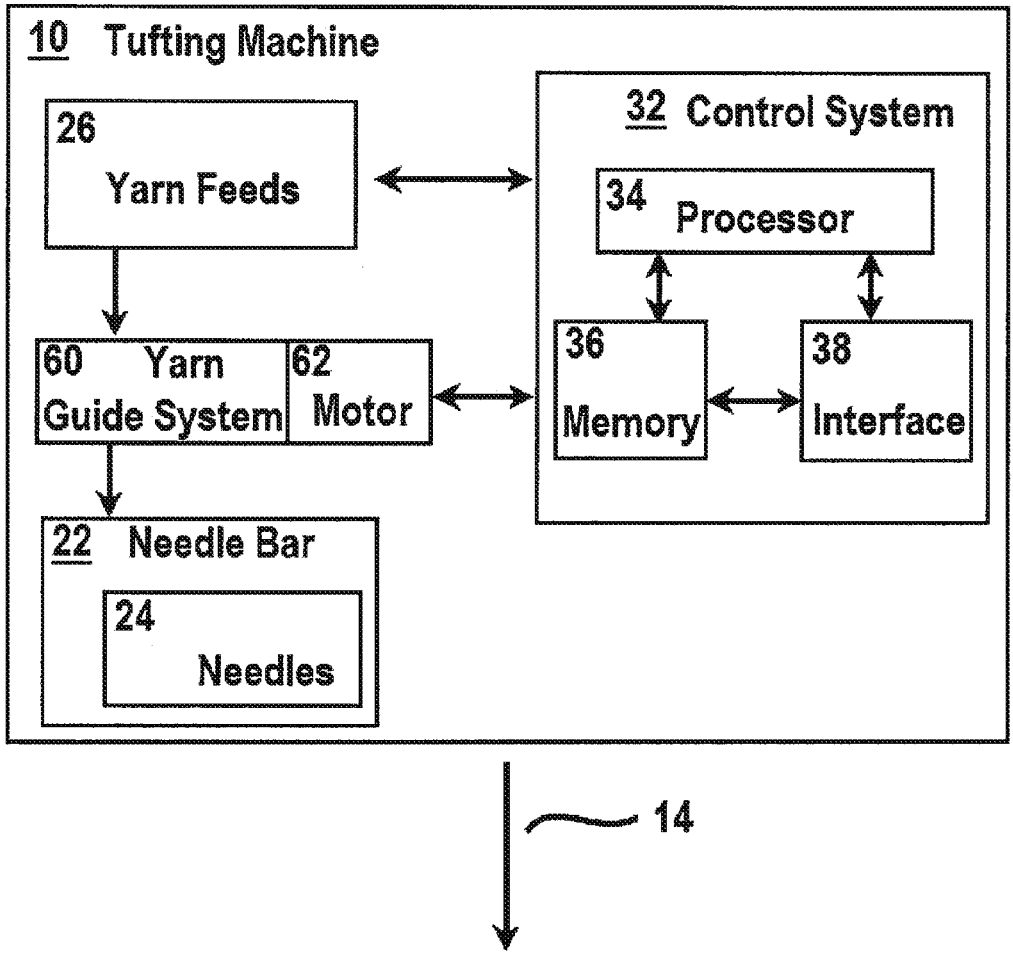
FIG. 5 is a schematic diagram depicting an exemplary tufting machine having a yarn guide system as described herein.

In another aspect, and with reference to FIG. 5, the means 30 for controlling the deviation of the ratio of different yarns projecting outwardly from the top surface of the backing material of each linear row relative to the operative ratio can further comprise at least one yarn guide system 60. In this aspect, each yarn guide system 60 of the at least one yarn guide system can be in operative communication with a corresponding yarn feed 26. In an additional aspect, each yarn guide system 60 of the at least one yarn guide system can comprise a linear slide having a longitudinal axis. In still another aspect, each yarn guide system 60 can comprise at least two fixed guides. Optionally, the at least two fixed guides can be mounted thereon the linear slide. It is contemplated that the at least two fixed guides can comprise, for example and without limitation, two, three, four, five, six, seven, or eight fixed guides. In a further aspect, each yarn guide system 60 can comprise at least one moveable guide. In this aspect, the at least one moveable guide can be adjustably mounted thereon the linear slide. Specifically, the at least one moveable guide can be selectively moveable axially along the longitudinal axis of the linear slide. In one exemplary embodiment, the at least two fixed guides can comprise two fixed guides, and the at least one moveable guide can comprise one moveable guide. In this embodiment, the at least one moveable guide can be positioned axially between the at least two fixed guides.

In an additional aspect, the means 30 for controlling the deviation of the ratio of different yarns projecting outwardly from the top surface of the backing material of each linear row relative to the operative ratio can comprise at least one motor 62. In this aspect, each motor 62 of the at least one motor can be coupled to a corresponding yarn guide system 60. In a further aspect, each motor 62 of the at least one motor can be configured to axially move the at least one moveable guide of its corresponding yarn guide system 60 along the longitudinal axis. In this aspect, as one having ordinary skill in the pertinent art will appreciate, each motor 62 can selectively adjust the yarn feed rate of the corresponding yarn feed.

In a further aspect, the means 30 for controlling the deviation of the ratio of different yarns projecting outwardly from the top surface of the backing material of each linear row relative to the operative ratio can further comprise means for selectively releasing tension on each yarn of the plurality of yarn feeds after the tufting machine decelerates to a motionless position. In still a further aspect, the means 30 for controlling the deviation of the ratio of different yarns projecting from the top surface of the backing material of each linear row relative to the operative ratio can further comprise means for selectively applying tension on each yarn of the plurality of yarn feeds prior to the initiation of acceleration of the tufting machine from the motionless position. As one having ordinary skill in the pertinent art will appreciate, the means for selectively releasing tension on each yarn of the plurality of yarn feeds and the means for selectively applying tension on each yarn of the plurality of yarn feeds can help maintain consistent tension in each yarn of the plurality of yarn feeds, thereby reducing the incidence of stop marks in the tufted carpet.

In one embodiment, a control system 32 for a tufting machine for forming tufted carpet is described. The control system 32 can be used to maintain the color of the tufted carpet 16 at a desired color during the operation of the tufting machine 10. In one aspect, the tufting machine 10 forms tufted carpet 16 on a backing material 12 moving in a machine direction 18 through the tufting machine. In another aspect, the backing material 12 can have a top surface. In a further aspect, the control system 32 comprises a processor 34.

In one aspect, the processor 34 of the control system 32 can be configured to perform the step of inserting loops of yarn 14 into the backing material 12 to form sequential substantially linear rows of yarn tufts thereon the backing material. In this aspect, a portion of each yarn tuft can project outwardly from the top surface of the backing material 12. In another aspect, the tufting machine 10 can operate at an operational speed. In another aspect, at the operational speed of the tufting machine 10, each respective linear row of yarn tufts can have an operational ratio of at least two different yarns projecting from the top surface of the backing material 12. In a further aspect, the at least two different yarns projecting from the top surface of the backing material 12 can form a desired color.

In another aspect, the processor 34 of the control system 32 can be programmed to perform the step of controlling the deviation of the ratio of different yarns projecting from the top surface of the backing material 12 of each linear row relative to the operational ratio as the speed of the tufting machine 10 deviates from the operational speed. In this aspect, the tufting machine 10 can deviate from the operational speed to a deviated speed. In another aspect, the processor 34 can be programmed to deviate the ratio of different yarns projecting from the top surface of the backing material 12 such that each linear row formed at the deviated speed is substantially the same color as the desired color. It is contemplated that the processor 34 can be coupled to a plurality of yarn feeds 26. It is further contemplated that the processor 34 can be configured to control the respective yarn feed rate of each yarn feed 26 of the plurality of yarn feeds.

In use, the tufting machine described herein can be provided to form tufted carpet on a backing material having a top surface. In one aspect, the backing material can be progressively fed along a machine direction through the tufting machine. In another aspect, as the backing material is progressively fed through the tufting machine, loops of yarn can be inserted into the backing material as described herein. Specifically, at an operational speed of the tufting machine, each respective linear row of yarn tufts can have an operational ratio of at least two different yarns projecting from the top surface of the backing material that form a desired color. In a further aspect, the deviation of the ratio of different yarns projecting outwardly from the top surface of the backing material of each linear row of yarn tufts relative to the operational ratio can be controlled as the speed of the tufting machine deviates from the operational speed. In an exemplary use, each linear row of yarn tufts formed at the deviated speed of the tufting machine can be substantially the same color as the desired color.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

What is claimed is:

1. A tufting machine for forming tufted carpet on a backing material moving in a machine direction through the tufting machine, the backing material having a top surface, the tufting machine comprising:

means for inserting loops of yarn into the backing material to form sequential substantially linear rows of yarn tufts thereon the backing material, wherein a portion of each yarn tuft projects from the top surface of the backing material, and wherein, at an operational speed of the tufting machine, each respective linear row of yarn tufts has an operational ratio of at least two different yarns projecting from the top surface of the backing material that form a desired color; and means for controlling the deviation of the ratio of different yarns projecting therefrom the top surface of the backing material of each linear row relative to the operational ratio as the speed of the tufting machine deviates from the operational speed such that each linear row formed at a deviated speed is substantially the same color as the desired color.

2. The tufting machine of claim 1, wherein the means for inserting loops of yarn into the backing material comprises:

a needle bar having a plurality of needles mounted thereon; and a plurality of yarn feeds, wherein each yarn feed of the plurality of yarn feeds is in operative communication with a needle of the plurality of needles, wherein each yarn feed of the plurality of yarn feeds comprises a respective yarn, wherein each yarn feed of the plurality of yarn feeds provides yarn to a corresponding needle of the plurality of needles at a selectable yarn feed rate, and wherein each yarn feed of the plurality of yarn feeds further comprises means for selectively adjusting the yarn feed rate.

3. The tufting machine of claim 2, wherein the means for controlling the deviation of the ratio of different yarns projecting therefrom the top surface of the backing material of each linear row relative to the operative ratio comprises a control system comprising a processor coupled to each yarn feed of the plurality of yarn feeds and configured to control the respective yarn feed rate of each yarn feed of the plurality of yarn feeds in response to deviation of the speed of the tufting machine from the operational speed.

4. The tufting machine of claim 3, wherein the control system is configured to signal at least one yarn feed of the plurality of yarn feeds to change its yarn feed rate to a selected yarn feed rate.

5. The tufting machine of claim 3, wherein, at the operational speed, each yarn feed of the plurality of yarn feeds has a normal yarn feed rate, and wherein the control system is configured to vary the yarn feed rate of at least one yarn feed of the plurality of yarn feeds substantially linearly from the normal feed rate to a selected yarn feed rate.

6. The tufting machine of claim 3, wherein, at the operational speed, each yarn feed of the plurality of yarn feeds has a normal yarn feed rate, and wherein the control system is configured to vary the yarn feed rate of at least one yarn feed of the plurality of yarn feeds substantially non-linearly from the normal feed rate to a selected yarn feed rate.

7. The tufting machine of claim 3, wherein the means for controlling the deviation of the ratio of different yarns projecting therefrom the top surface of the backing material of each linear row relative to the operative ratio further comprises:

at least one yarn feed roller in operative communication with a corresponding yarn feed; and at least one motor, wherein each motor is coupled to one yarn feed roller, wherein each motor is configured to drive the yarn feed roller to selectively adjust the yarn feed rate of the corresponding yarn feed.

8. The tufting machine of claim 3, wherein the means for controlling the deviation of the ratio of different yarns projecting therefrom the top surface of the backing material of each linear row relative to the operative ratio further comprises:

at least one s-bar system in operative communication with a corresponding yarn feed; and at least one motor, wherein each motor is coupled to one s-bar system, wherein each motor is configured to rotate the s-bar system to selectively adjust the yarn feed rate of the corresponding yarn feed.

9. The tufting machine of claim 8, wherein the at least one motor comprises a direct current motor.

10. The tufting machine of claim 8, wherein the at least one motor comprises a stepper motor.

11. The tufting machine of claim 8, wherein the at least one motor comprises a servo motor.

12. The tufting machine of claim 3, wherein the means for controlling the deviation of the ratio of different yarns projecting therefrom the top surface of the backing material of each linear row relative to the operative ratio further comprises:

at least one yarn guide system, wherein each yarn guide system is in operative communication with a corresponding yarn feed, each yarn guide system comprising:

a linear slide having a longitudinal axis;

at least two fixed guides fixedly mounted thereon the linear slide; and at least one moveable guide adjustably mounted thereon the linear slide, wherein the at least one moveable guide is selectively moveable axially along the longitudinal axis of the linear slide; and at least one motor, wherein each motor is coupled to a corresponding yarn guide system, wherein each motor is configured to axially move the at least one moveable guide of its corresponding yarn guide system along the longitudinal axis of the linear slide to selectively adjust the yarn feed rate of the corresponding yarn feed.

13. The tufting machine of claim 1, wherein the sequential substantially linear rows of yarn tufts thereon the backing material are spaced substantially equally apart in the machine direction.

14. The tufting machine of claim 1, wherein the linear rows of yarn tufts thereon the backing material are substantially transverse to the machine direction.

15. The tufting machine of claim 3, wherein the means for controlling the deviation of the ratio of different yarns projecting therefrom the top surface of the backing material of each linear row relative to the operative ratio further comprises means for selectively releasing tension on each yarn of the plurality of yarn feeds after the tufting machine decelerates to a motionless position.

16. The tufting machine of claim 15, wherein the means for controlling the deviation of the ratio of different yarns projecting therefrom the top surface of the backing material of each linear row relative to the operative ratio further comprises means for selectively applying tension on each yarn of the plurality of yarn feeds prior to the initiation of acceleration of the tufting machine from the motionless position.

* * * * *